US007954506B2

(12) United States Patent
Swan

(10) Patent No.: US 7,954,506 B2
(45) Date of Patent: Jun. 7, 2011

(54) AUTOMATIC FREEZE PROTECTION SYSTEM FOR DOMESTIC PLUMBING SYSTEMS

(76) Inventor: John David Swan, Bend, OR (US)

( * ) Notice: Subject to any disclaimer, the term of this patent is extended or adjusted under 35 U.S.C. 154(b) by 0 days.

(21) Appl. No.: 10/420,213

(22) Filed: Apr. 21, 2003

(65) Prior Publication Data

US 2004/0206394 A1 Oct. 21, 2004

(51) Int. Cl.
*F16K 17/38* (2006.01)

(52) U.S. Cl. ..... 137/80; 137/59; 137/79; 137/334; 137/565.17; 137/565.35

(58) Field of Classification Search ..... 137/79, 137/80, 341, 334, 565.35, 565.17, 59
See application file for complete search history.

(56) References Cited

U.S. PATENT DOCUMENTS

| | | | | | |
|---|---|---|---|---|---|
| 2,840,101 | A | * | 6/1958 | Saylor | 137/335 |
| 4,286,617 | A | * | 9/1981 | Bedient | 137/334 |
| 4,298,021 | A | * | 11/1981 | Bozeman | 137/334 |
| 4,531,538 | A | * | 7/1985 | Sandt et al. | 137/334 |
| 4,848,389 | A | * | 7/1989 | Pirkle | 137/80 |
| 5,488,968 | A | * | 2/1996 | Price et al. | 137/1 |
| 5,694,963 | A | | 12/1997 | Fredell et al. | |
| 5,746,240 | A | * | 5/1998 | Ayotte et al. | 137/59 |
| 5,806,511 | A | | 9/1998 | Hart | |
| 6,212,894 | B1 | | 4/2001 | Brown et al. | |
| 6,247,191 | B1 | | 6/2001 | Detar et al. | |
| 6,338,364 | B1 | | 1/2002 | Mendenhall | |

* cited by examiner

*Primary Examiner* — A. Michael Chambers
(74) *Attorney, Agent, or Firm* — Glenn C. Brown, P.C.

(57) ABSTRACT

A plumbing system operable to automatically introduce anti-freeze into the hot and cold water systems responsive to a signal from a controller. The controller activates the system automatically at a predetermined ambient temperature. The system can also be reconfigured manually.

7 Claims, 4 Drawing Sheets

AUTOMATIC FREEZE PROTECTION SYSTEM FOR DOMESTIC PLUMBING SYSTEMS

This invention is related to domestic plumbing systems, and in particular to an apparatus and method for protecting a home or other building from the extensive damage that can result from the freezing and resulting bursting of pipes within walls and ceilings of a building.

A typical domestic plumbing system receives water from a municipal supply system or a well, and then distributes the water as hot and cold water to fixtures throughout the house. The piping that makes up the plumbing system is installed within the walls and ceilings of the building for cosmetic purposes. Such systems work very well, and provide reliable service under most conditions. One potential problem with such systems arises if and when the heating system in the building fails, and the internal temperature of the building falls below freezing. If this occurs while the building is unoccupied, the pipes can freeze and burst, causing extensive damage to the building. The damage can be particularly severe if the water service to the building has not been turned off at the supply valve, in which case water will continue to flow into the building until the leak is discovered hours or even days later.

This invention addresses this problem by providing a plumbing system that includes an antifreeze dispensing apparatus that can be activated to inject a predetermined amount of antifreeze into the plumbing system and prevent the freezing of the pipes and fixtures. The antifreeze is a nontoxic antifreeze that is approved for domestic use, and that can be readily flushed from the system using only fresh water form the normal supply. In another aspect of the invention, the apparatus senses when the temperature in the building has dropped to freezing and automatically shuts the water supply valve to the plumbing system. These and other features of the invention will be described in greater detail be reference to the drawings.

BRIEF DESCRIPTION OF THE DRAWINGS

FIG. 5 is a partial cut away view of the

DETAILED DESCRIPTION OF PREFERRED EMBODIMENTS

Figure 1:
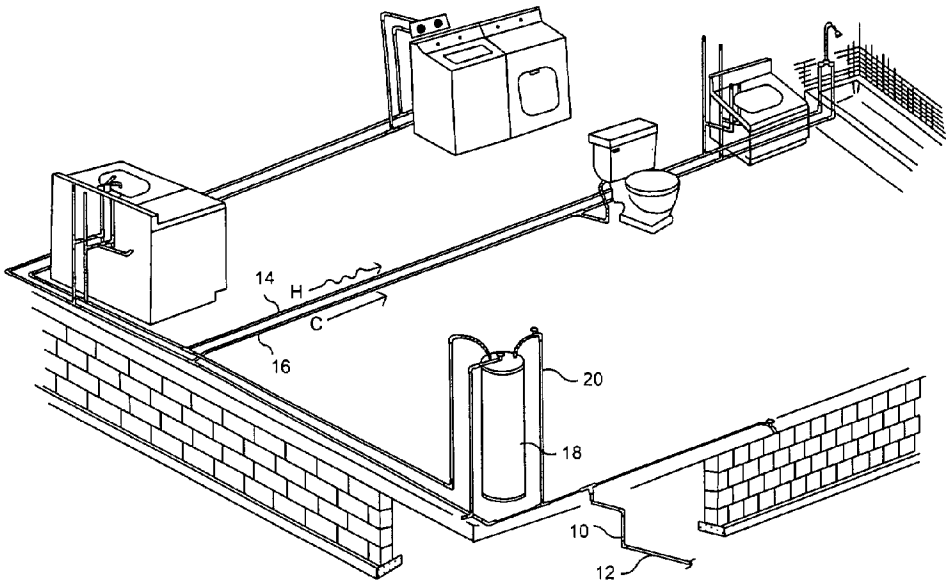
FIG. 1 is a schematic drawing of a typical domestic plumbing system including various domestic appliances and fixtures, and the required hot and cold water supply lines.
Figure 2:
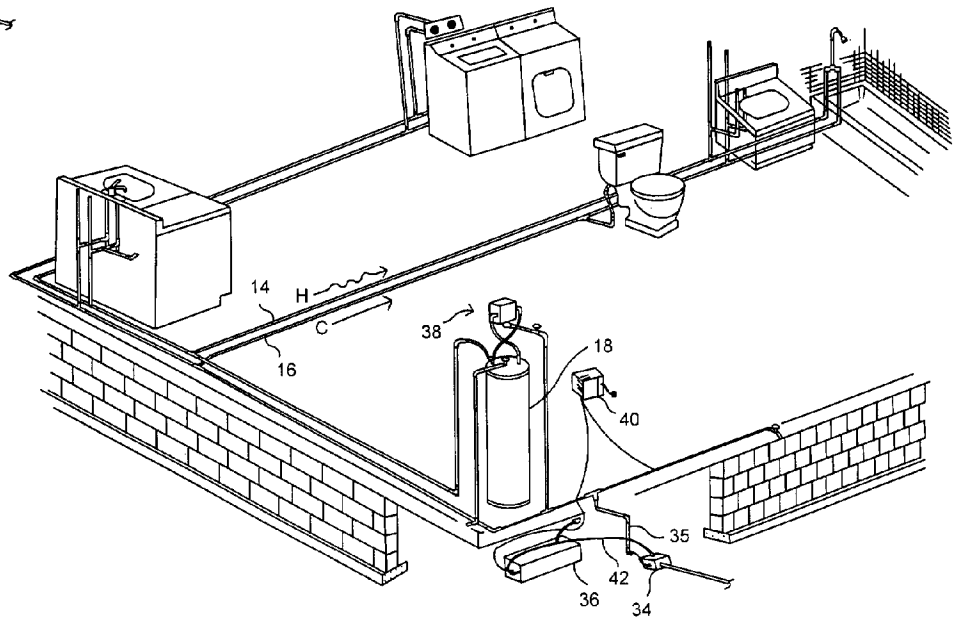
FIG. 2 is a schematic drawing of a domestic plumbing system according to a preferred embodiment of the present invention.

Turning now to FIG. 1, a typical domestic plumbing system includes a water supply 10, a water supply cut-off valve 12, backflow preventer, and separate hot and cold water supply piping systems 14 and 16 respectively. The hot water system 14 includes a hot water heater 18, a cold water supply 20 to the water heater 18, and a hot water supply piping system to supply hot water to appliances such as the dishwasher 22, clothes washer 24, sinks 26 in the bathrooms and kitchen, and bathtubs 28. The cold water supply piping system 16 supplies cold water to each of these same appliances and fixtures, and also to toilets 30 and hose bibs 32.

In one preferred embodiment of the invention, a freeze protection system includes, in addition to the components enumerated for the typical domestic plumbing system, a cold water supply valve controller 34, an antifreeze storage tank assembly 36, a bypass valve assembly 38, and a controller assembly 40. The water supply valve controller 34 includes a water supply shut off valve (not shown). An antifreeze supply line 42 connects water supply valve controller 34 to the antifreeze storage tank assembly 36. The antifreeze storage tank assembly 36 includes a pump (not shown) to dispense antifreeze within the storage tank assembly 36 through line 42 to the water supply controller valve 34 and into the water supply line 35. The pump is preferably a low voltage pump that is supplied with low-voltage current from a transformer connected to the building's electrical system (not shown) under normal operation. In the event of a power outage, the storage tank assembly 42 includes a backup battery (not shown) for operating the pump.

Figure 4:
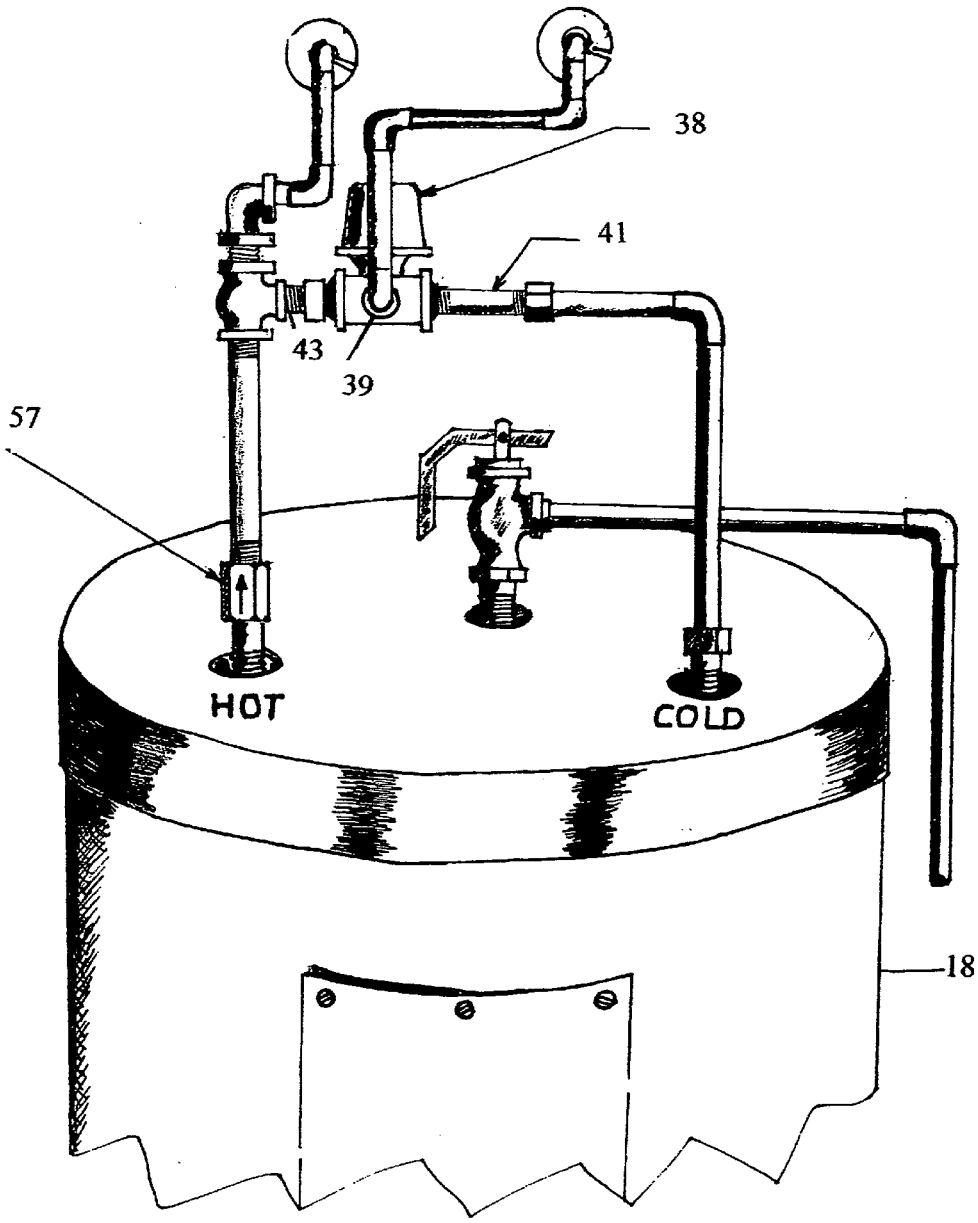
FIG. 4 is an enlarged perspective view of connections between the bypass valve assembly, the water heater and the water supply shown in FIG. 1.
Figure 5:
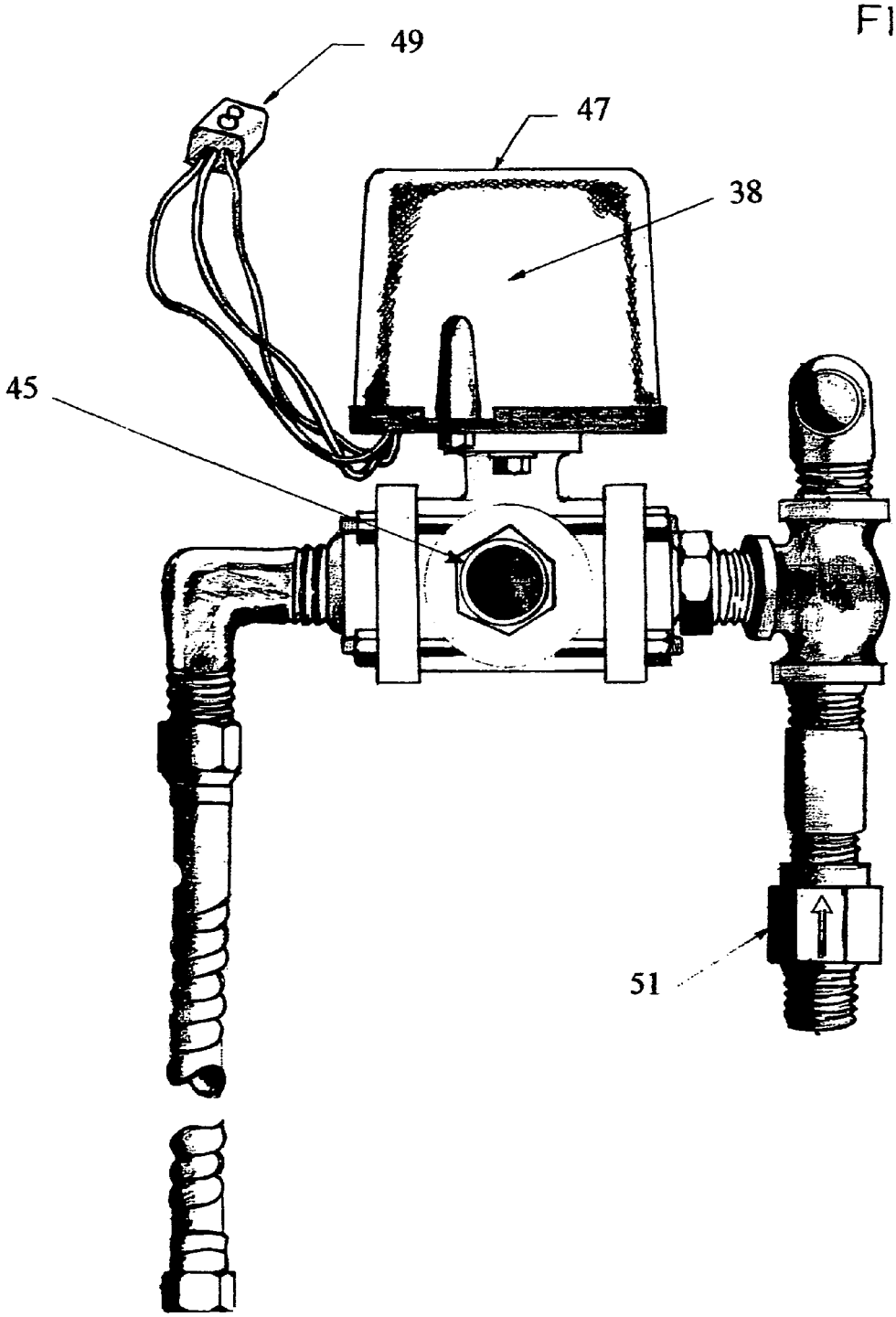

Referring to FIGS. 4 and 5, bypass valve assembly 38 includes an electrically operated three-way valve that can be configured to direct a supply of cold water into the water heater 18 under normal operation, and to bypass the water heater 18 and redirect cold water directly into the hot water piping system 16. Bypass valve 38 in the preferred embodiment is a three way ball valve with its inlet 39 connected to the cold water inlet line from the water supply controller valve 34. One outlet 41 of bypass valve 38 directs cold water to the hot water heater 18 under normal conditions. A second outlet 43 directs cold water to bypass water heater 18 and go directly into the hot water system of the building. This configuration is used to introduce antifreeze into the hot water system of the building. A check valve 51 is installed between the water heater hot water outlet 53 and bypass valve 38 to prevent backflow into the water heater discharge from the bypass valve. Referring to FIG. 5, bypass valve 38 includes a ball assembly 45 that is rotated between the first and second configurations by actuator 47. Actuator 47 is connected by wires 49 to controller assembly 40, which operates the bypass valve as described below.

Figure 3:
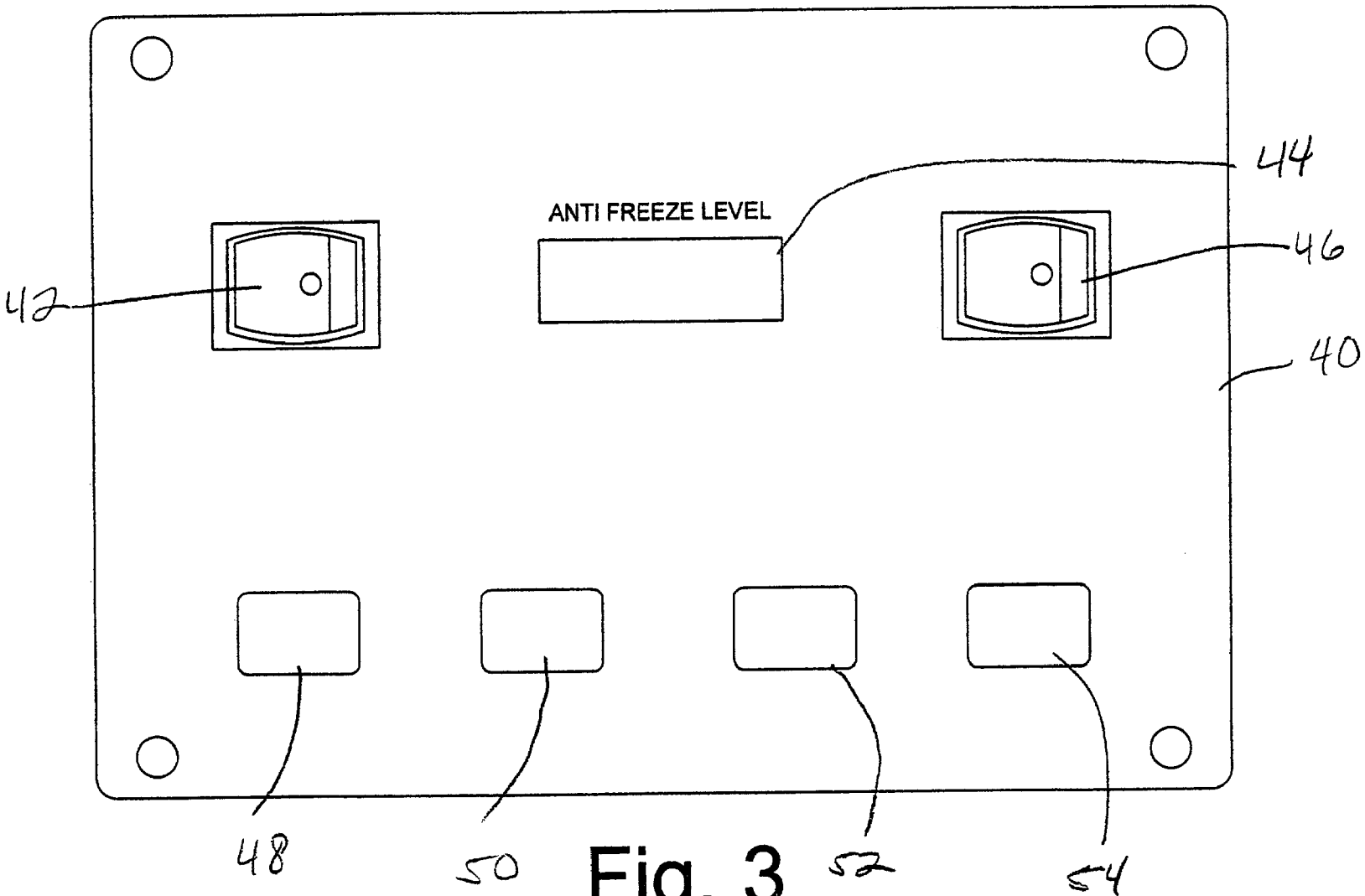
FIG. 3 is a front view of a system controller.

The controller assembly 40 is preferably an electronic as shown FIG. 3. Controller 40 includes an outside temperature monitor 42, an antifreeze level indicator 44, an inside temperature monitor 46, a switch 48 to initiate the winterization process, a switch 50 to activate the bypass valve assembly 38, a switch 52 to activate the battery backup for antifreeze injection pump, and a water damage control switch 54 to activate the water. supply controller valve 34 in order to isolate the plumbing system from the water supply system if temperatures drop to −30° F.

The operation of the system will now be described. Under normal operation, water supply controller 34 directs water from the water supply system to the plumbing system. Cold water is directed into the cold water piping system 16, and also through bypass valve assembly 38, hot water heater 18 and into the hot water piping system 14.

When the building is going to be unoccupied for a period of time in which it would be possible for the plumbing system to be exposed to freezing temperatures, the user presses the bypass switch 50, followed by the winterize switch 48. The system is activated to configure bypass valve assembly 38 to redirect water away from the hot water heater and directly into the hot water piping system 14. The system then activates the antifreeze pump to supply antifreeze from storage tank assembly 42 to the water supply controller, which injects the antifreeze into the water entering the plumbing system of the building. Water valves on the appliances and fixtures are then opened to permit the water/antifreeze solution to flow through and fill the plumbing system, and are then closed. The hot and cold water piping systems are then protected from freezing temperatures. Applicant has found that a ratio of 50% propylene glycol is suitable for protecting the system to a temperature of about −50 F. A higher concentration of antifreeze can be obtained by adjusting the water supply controller 34 to inject a greater amount of antifreeze into the water entering the system. In this way the system can be protected to a temperature of −60° F. Once the plumbing system has been flushed with the antifreeze mixture, the valves on the appliances and fixtures are closed. The water supply controller 34 is then activated again, and shuts the water supply valve, protecting the system in the event of a leak in the system during the owner's absence. The winterize injection switch also deactivates the pump in the antifreeze storage assembly 36. The water heater can be turned off and drained since it is isolated from the rest of the system.

When the building is to be reoccupied, the bypass switch 50 is activated, configuring the bypass valve 38 to its bypass operating configuration. The winterize switch 48 is activated to normal flow to open the water supply valve. The water valves at each appliance are opened to permit fresh water to completely flush the antifreeze from the system in preparation for normal use of the building. After flushing is complete, the bypass 50 is activated to normal flow position and the water heater will fill at this time.

In the preferred embodiment the system is activated and controlled by a 12 volt electrical system. In other embodiments some or all of the system configuration and activation can be done manually.

Some functions of the system can be activated individually. For example, if the building is to be unoccupied, but freezing is not a concern the water damage control switch 54 can be activated to shut off the water supply to the building while unoccupied. If it is necessary to service the water heater, the bypass valve can be operated separately to isolate the water heater from the rest of the system. Finally, if power to the building is interrupted, the water damage control 54 will activate closing the flow of water supply.

The antifreeze solution can be any suitable solution approved for domestic potable water systems. Applicant has identified prop glycol, available from Dow Chemical, as one such preferred antifreeze solution.

While the invention has been described by reference to the foregoing preferred embodiments, the invention is not intended to be limited thereby. Those of skill in the art will understand that numerous modifications and variations are possible without departing from the scope of the following claims.

What is claimed is:

1. A plumbing system for a building, the plumbing system including hot and cold water distribution systems, one or more water-using appliances connected to the hot and cold water distribution systems, a water supply connected to the hot and cold water distribution systems, and a water heater, the improvement comprising:

a water supply control valve assembly operable to isolate the water supply from the plumbing system;

a liquid injector operable to inject a liquid antifreeze into the plumbing system;

a bypass check valve assembly connected to the cold water distribution system, the hot water distribution system, and the water heater, the bypass assembly operable to a first configuration connecting the water supply to an inlet of the water heater, and operable to a second configuration connecting the water supply directly to the hot water distribution system and bypassing the water heater;

an antifreeze tank including an antifreeze reservoir and a pump, the antifreeze tank operable to pump antifreeze from the reservoir to the liquid injector; and, a controller in communication with the antifreeze tank, the bypass assembly, the water supply control valve, an ambient temperature sensor, and the liquid injector, the controller operable to operate the bypass assembly between its first and second configurations, to operate the water supply assembly to isolate the water supply from the plumbing system, to activate the antifreeze tank to pump liquid from the reservoir to the liquid injector, and to operate the liquid injector to inject antifreeze into the plumbing system.

2. A plumbing system according to claim 1 wherein the controller is operable to configure the plumbing system into a first predetermined configuration responsive to a predetermined ambient temperature, the first predetermined configuration including isolating the water supply from the plumbing system.

3. A plumbing system according to claim 1 wherein the plumbing system is connected to a primary power source, and wherein the controller is operable to configure the plumbing system into a second predetermined configuration responsive to a failure of the primary power source, the second predetermined configuration including the plumbing system connected to a secondary power source.

4. A plumbing system according to claim 1 having a third predetermined configuration in which the water supply is connected to the plumbing system, the bypass assembly is in its second configuration connecting the water supply directly to the hot water distribution system and bypassing the water heater; and the liquid injector is injecting antifreeze into the plumbing system.

5. A plumbing system according to claim 1 wherein the controller is operated electrically and generates electrical signals to configure the system.

6. A plumbing system according to claim 1 wherein the system can be reconfigured manually.

7. A plumbing system according to claim 1 wherein the bypass assembly includes a three-way valve.

* * * * *